US010986880B2

(12) United States Patent
Stephens et al.

(10) Patent No.: US 10,986,880 B2
(45) Date of Patent: Apr. 27, 2021

(54) MASTECTOMY BRA

(71) Applicant: THE MARENA GROUP, LLC, Lawrenceville, GA (US)

(72) Inventors: Jeffrey Dan Stephens, Atlanta, GA (US); Terrell Douglas Abney, Atlanta, GA (US); Linda Marie Burhance, Newtown, CT (US); Jeffrey Robert Cellini, Peachtree City, GA (US)

(73) Assignee: THE MARENA GROUP, LLC, Lawrenceville, GA (US)

( * ) Notice: Subject to any disclaimer, the term of this patent is extended or adjusted under 35 U.S.C. 154(b) by 38 days.

(21) Appl. No.: 15/983,367

(22) Filed: May 18, 2018

(65) Prior Publication Data

US 2018/0332905 A1 Nov. 22, 2018

Related U.S. Application Data

(60) Provisional application No. 62/507,991, filed on May 18, 2017.

(51) Int. Cl.

| | |
|---|---|
| ***A41C 3/02*** | (2006.01) |
| ***A41C 3/00*** | (2006.01) |
| ***A41C 3/12*** | (2006.01) |

(52) U.S. Cl.

CPC ..... *A41C 3/0064* (2013.01); *A41C 3/12* (2013.01); *A41C 3/0035* (2013.01); *A41C 3/02* (2013.01)

(58) Field of Classification Search

CPC ..... A41C 3/0064; A41C 3/12; A41C 3/0035
USPC ..... 450/58
See application file for complete search history.

(56) References Cited

U.S. PATENT DOCUMENTS

| | | | | |
|---|---|---|---|---|
| 3,378,013 | A * | 4/1968 | Bruno | A41C 3/00 450/58 |
| 3,529,307 | A | 9/1970 | Belson et al. | |
| 5,257,956 | A * | 11/1993 | Ewen | A41C 3/148 2/102 |
| 5,378,192 | A * | 1/1995 | Darmante | A41C 3/0028 2/106 |
| 6,055,668 | A * | 5/2000 | Gros | A41D 13/1245 2/69 |
| 6,936,021 | B1 | 8/2005 | Smith | |
| 7,396,272 | B1 | 7/2008 | Newlen | |
| 8,337,275 | B2 * | 12/2012 | Martins-Crawbuck | A41C 3/0028 450/62 |
| 8,562,388 | B2 | 10/2013 | Izzo et al. | |
| 8,944,974 | B2 | 2/2015 | Foster | |
| 9,161,574 | B2 | 10/2015 | Swendseid et al. | |
| 9,545,124 | B1 * | 1/2017 | Thompson | A41C 3/0064 |
| 9,591,880 | B2 | 3/2017 | Lee et al. | |

(Continued)

OTHER PUBLICATIONS

Search Report for International Patent Application No. PCT/US2018/033349, dated Aug. 13, 2018.

(Continued)

*Primary Examiner* — Timothy K Trieu
(74) *Attorney, Agent, or Firm* — Barnes & Thornburg LLP; Jason A. Bernstein

(57) ABSTRACT

A brassiere garment for post-mastectomy surgery including a vest portion having a first and second cup, a front closure, a support band associated with a bottom portion of the garment, and at least one elastic strip. The garment may also include at least one removable retention member and a removable pouch.

17 Claims, 3 Drawing Sheets

(56) References Cited

U.S. PATENT DOCUMENTS

| | | | | |
|---|---|---|---|---|
| 9,951,880 | B2 | 4/2018 | Thomas et al. | |
| 2006/0206978 | A1 | 9/2006 | Hilton et al. | |
| 2010/0121288 | A1 | 5/2010 | Timmons | |
| 2011/0034889 | A1 | 2/2011 | Smith | |
| 2013/0171911 | A1 | 7/2013 | Swendseid et al. | |
| 2015/0080860 | A1 | 3/2015 | Farrell | |
| 2015/0099420 | A1* | 4/2015 | Reinhard ..... | A41C 3/02 450/58 |
| 2015/0296896 | A1 | 10/2015 | Laguna | |
| 2016/0066624 | A1 | 3/2016 | Blackwell | |
| 2016/0143424 | A1 | 5/2016 | Stephens et al. | |
| 2016/0213886 | A1 | 7/2016 | Digiorgi | |
| 2016/0367021 | A1 | 12/2016 | Moreau et al. | |
| 2017/0056630 | A1 | 3/2017 | Fee | |
| 2017/0202274 | A1 | 7/2017 | Blackwell | |
| 2020/0077718 | A1 | 3/2020 | Thompson | |

OTHER PUBLICATIONS

Omer Cordura Belt Pocket for Light/Weights, URL: hllps://www.scubastore.com/scuba-diving/omer-cordura-belt-pocket-for-light-weights/1245552/p, Jan. 11, 2017.

International Preliminary Report on Patentability for Application No. PCT /US2018/033349; dated Mar. 5, 2020.

* cited by examiner

MASTECTOMY BRA

CROSS-REFERENCE TO RELATED APPLICATION

This application claims benefit of U.S. Provisional Patent Application No. 62/507,991, filed May 18, 2017, entitled MASTECTOMY BRA, and commonly assigned to the assignee of the present application, the disclosure of which is incorporated by reference in its entirety herein.

FIELD

The present disclosure relates, in exemplary embodiments, to a brassiere-type garments suitable for use after a mastectomy.

BACKGROUND

After mastectomy surgery the patient typically must, or should, wear a post-surgery compression garment to help speed recovery and improve comfort. Frequently, a drainage tube inserted near the incision or proximal area is needed to drain fluid from the surgery area. The tube usually drains into a drainage bulb. Both the tube and the bulb are essentially "attached" to the patient, and carrying both around can be cumbersome and embarrassing. Additionally, the tube may occasionally need to be repositioned. It would be desirable to have a garment worn post-surgery that can accommodate and retain both the tube and the bulb (and other items). It would also be desirable for such a garment to accommodate adjusting the position of the tube and/or pouch around the garment as needed to maintain comfort. It would also be desirable for such a garment to have desirable compression and breathability characteristics to help with healing.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

Generally described, the present disclosure provides in a first exemplary embodiment, a brassiere garment suitable for use post-mastectomy surgery, is described, comprising a vest portion having a first cup and a second cup; a front closure; an elastic support band associated with a bottom portion of the vest portion; at least one elastic strip associated with the bra; at least one retention member removably attachable to a portion of the at least one elastic strip; and, a pouch adapted to be removably associated with a portion of the at least one elastic strip.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which.

DETAILED DESCRIPTION

Unless otherwise indicated, the drawings are intended to be read (for example, cross-hatching, arrangement of parts, proportion, degree, or the like) together with the specification, and are to be considered a portion of the entire written description of the invention. As used in the following description, the terms "horizontal", "vertical", "left", "right", "up" and "down", "upper" and "lower" as well as adjectival and adverbial derivatives thereof (for example, "horizontally", "upwardly", or the like), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
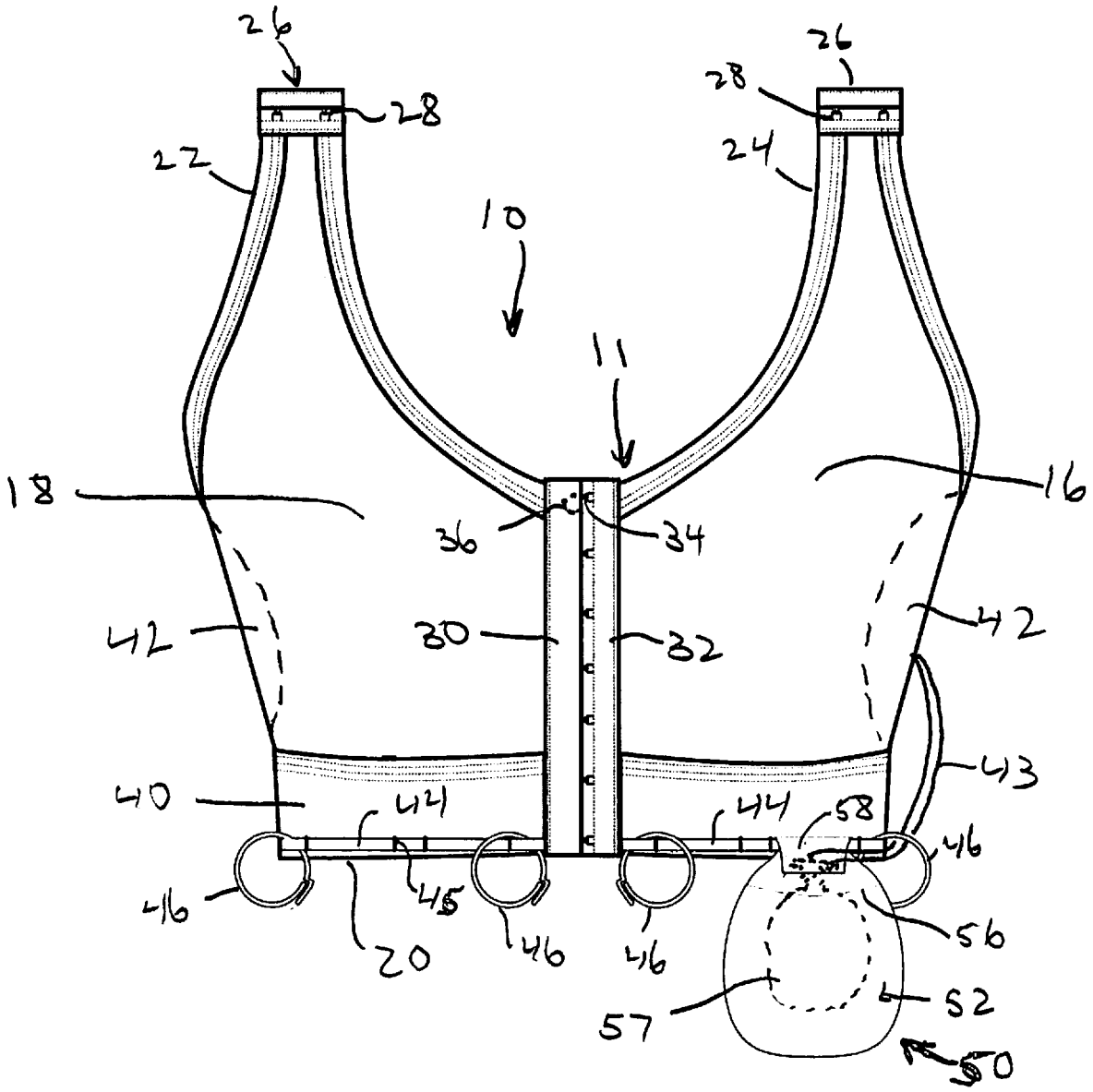
FIG. 1 is a front elevational view of one exemplary embodiment of a mastectomy bra.
Figure 2:
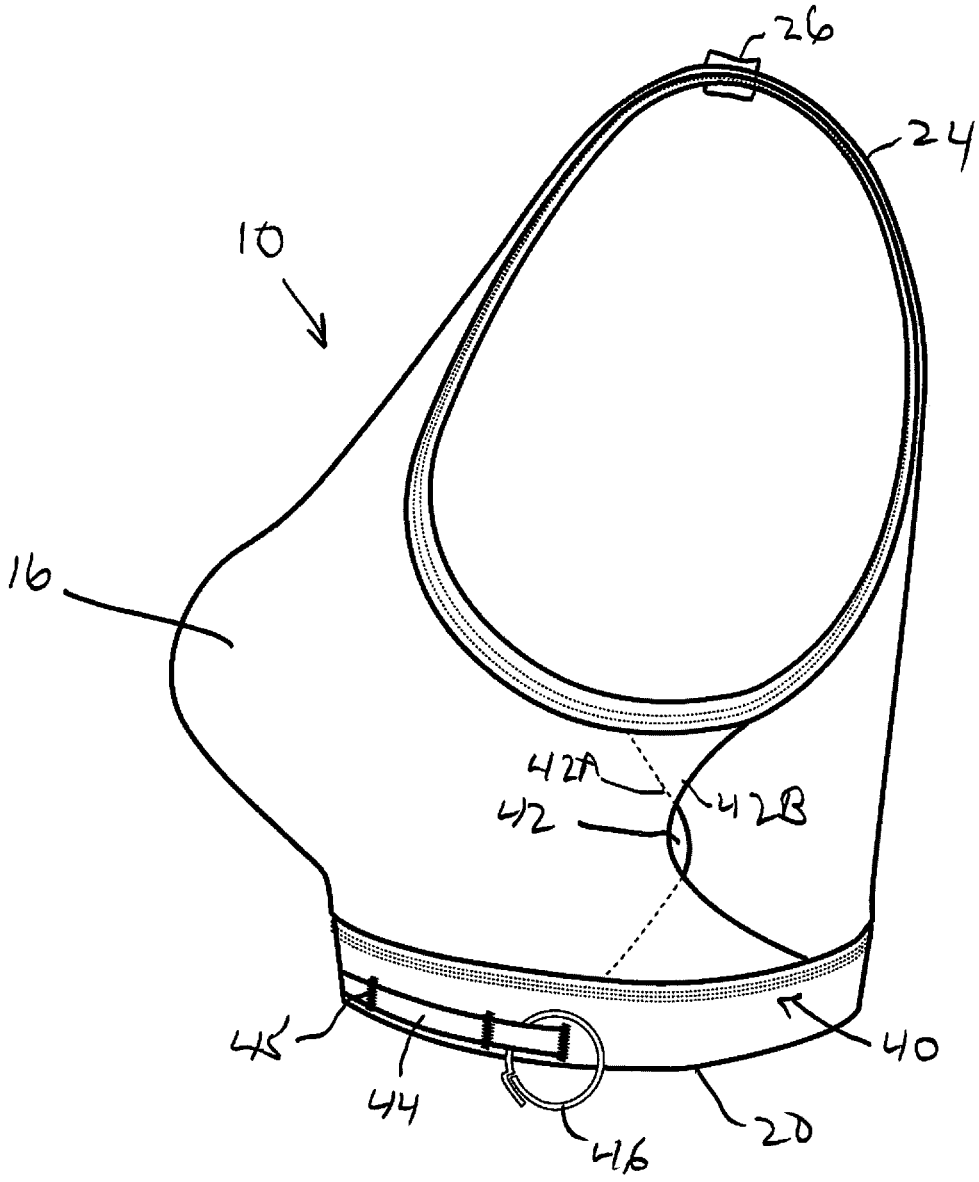
FIG. 2 is a side perspective view of the exemplary embodiment of FIG. 1.
Figure 3:
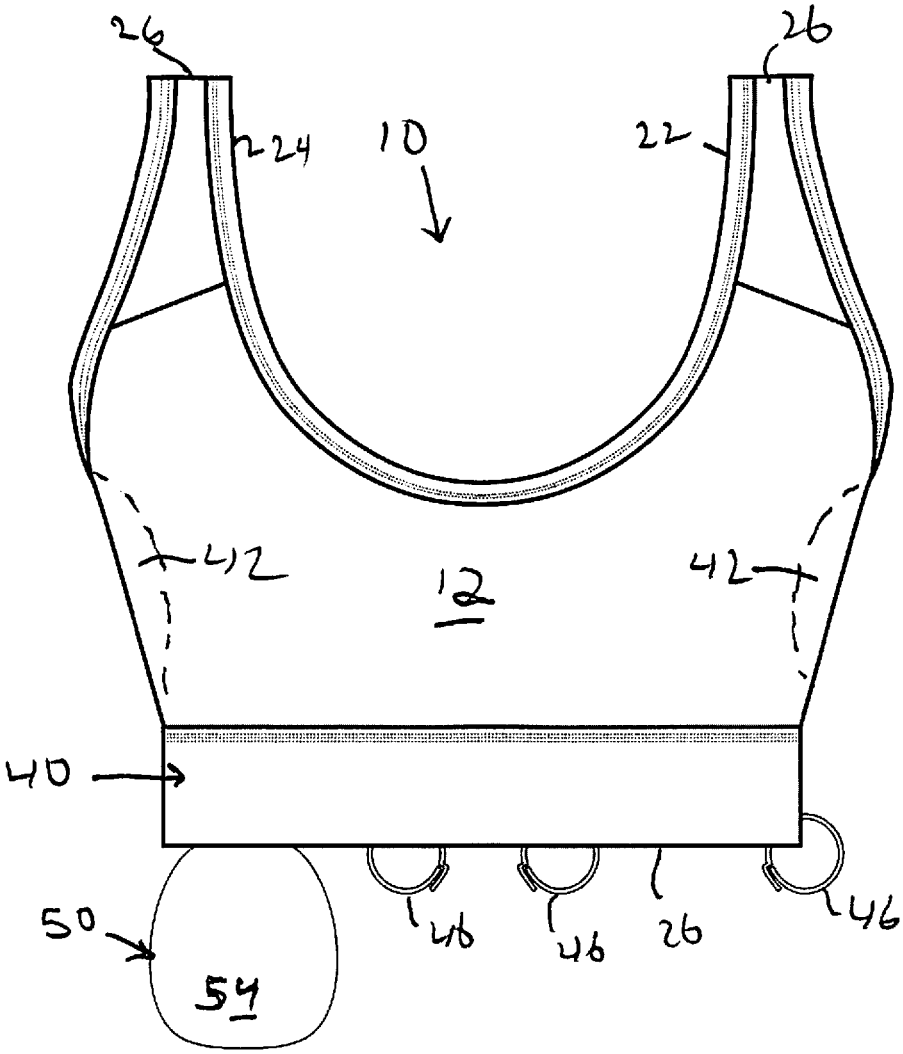
FIG. 3 is a rear elevational view of the exemplary embodiment of FIG. 1.

FIGS. 1-3 shows one exemplary embodiment of a mastectomy brassiere garment 10 (also referred to as a vest or a bra) generally comprising a vest portion 11 rear fabric portion 12, and a front portion 14 having left and right cups 16, 18 to receive a breast or a prosthetic breast, and a bottom edge 20. The garment 10 may be made of an elastic fabric. In an exemplary embodiment, the fabric may be a compression fabric, such as, but not limited to, at least one warp knit compression fabric. In one exemplary embodiment, the fabric comprises a compression fabric having elasticity in the warp direction being substantially the same (e.g., within 10-20%) as the elasticity in the weft direction. In one exemplary embodiment, the fabric is Comfortwear® brand fabric (available from The Marena Group, LLC, Lawrenceville, Ga.). In exemplary embodiments, at least a portion of the fabric comprising the vest portion 11 may be treated with an anti-microbial agent for optimal healing. In exemplary embodiments, the anti-microbial agent may be Silvadur™ (available from Dow Chemical Company). In an alternative embodiment, the vest portion 11 may have only one formed cup, and, where the other cup would be can be fabric.

The garment 10 has a first shoulder strap 22 and a second shoulder strap 24. Each strap may have an adjustable strap closure 26 having at least one clasp. The garment 10 has a front closure comprising a first closure portion 30 and a second closure portion 32. The closure portions 30, 32 can be removably joined by one or more closure mechanisms, such as, but not limited to, clasps, eye-and-hook, hook-and-loop, snaps, buttons, magnets, or the like. As shown in FIG. 1, pairs of eyes 34 and hooks 36 are utilized as the closure mechanism. In exemplary embodiments, the closure mechanisms can be arranged in rows spaced generally from the top to the bottom of the front closure (hidden closure mechanism portions shown in phantom in FIG. 1) to permit adjusting the overall circumferential fit of the bra for different size wearers.

In exemplary embodiments, the garment 10 includes an elastic support band 40 proximate to the bottom edge 20 of the garment 10. The support band 40 assists in maintaining the garment 10 in place and is placed at the bottom of the garment area to avoid sensitive healing areas after surgery. In exemplary embodiments, the support band 40 may be formed of a separate piece of elastic material and attached to the garment material. In exemplary embodiments, the support band 40 is sewn on top of the outside of the vest fabric to prevent or reduce irritation of scars caused by surgery.

In exemplary embodiments, there is an opening 42 in one or both sides of the garment 10 by having overlapping pieces of fabric or flaps of fabric 42A, 42B (as shown in FIG. 2). The opening 42 can permit easy access to a drainage tube 43 while still maintaining integrity of the garment sides.

In exemplar embodiments, at least one elastic strip 44, and in exemplary embodiments, a plurality of elastic strips are attached to the support band 40. Where a plurality of elastic strips 44 are utilized, the elastic strips 44 may be attached at spaced apart locations, such as by a tack stitch 45. FIG. 1 shows a portion of an elastic strip 44 on each side of the front closure, whereby the elastic strip 44 is attached in various locations to the support band 40 to create areas for attachment. One or more retention members 46 can be attached to the elastic strip any of various locations. In exemplary embodiments the retention member 46 can be a ring, such as, but not limited to, a split ring which can be removably associated with the elastic strip 44. In exemplary embodiments, instead of a ring, a clip, a loop of fabric having a snap, button, hook-and-loop, or other closure mechanism, can be used. In exemplary embodiments, different types of retention members can be used. One or more drainage tubes, or other tube-type components, can pass through the split ring.

In an alternative exemplary embodiment, the at least one elastic strip 44 may be attached to the garment 10 below the support band 40, rather than being attached to the support band 40, such as being attached at an area proximate to the bottom edge 20 of the garment.

A pouch (or pouches) 50 can be removably attached to the garment 10. In exemplary embodiments, the pouch 50 comprises front and back fabric portions 52, 54 that are attached at the edges, and having an opening 56 in at least one side (and, optionally, an opening in both sides) into which a drainage bulb 57 or other item can be removably inserted. In exemplary embodiments, the pouch 50 can be removably attached to an elastic strip 44 by an attachment portion 58 having, in exemplary embodiments a strip of hook material and a matable strip of loop material, each attached to the attachment portion. The attachment portion 58 can be folded over an elastic strip and the hook and loop strips mated to prevent removal until desired. The pouch 50 can be positioned at different places along an elastic strip 44 for easy adjustment.

In an alternative exemplary embodiment, the attachment portion 58 of the pouch 50 may have a strip of either hook material or loop material attached thereto, and the mating material can be attached to a portion of the support band, whereby the pouch 50 is directly attached to the support band 40. In alternative exemplary embodiments, other attachment mechanisms, such as, but not limited to, clasps, eye-and-hook, snaps, buttons, magnets, or the like, may be used.

A wearer can wear the garment 10 with or without the pouch 50 and with or without the retention members 46.

A feature of exemplary embodiments of the garment 10 is that the retention members 46 can be removed, or can be moved to different locations around the support band 40 and generally maintained in place (within the elastic strip 44 segment between two adjacent tack stitches) so that the wearer can position the drainage tube or tubes in a comfortable location. Another feature of exemplary embodiments of the garment 10 is that the pouch 50 can be attached to the garment 10 at different locations, or removed, for greater comfort. The "stay-put" elastic support band is designed to help keep the garment 10 in place and prevent riding up on the wearer. The side openings 56 allow for ease of access to the drainage tube while still maintaining integrity of the garment sides. The retention members 46 can be moved to different places around the support band 40 by attaching to the strip 44 in any of various places, thus allowing the tube 43 or bulb 57 to be moved to promote comfort. The fabric promotes four-way stretch and 360 degree gentle support. The fabric can be treated with an antimicrobial. The fabric material can, in exemplary embodiments promote high oxygenation value for breathability. Where desired, the retention members 46 or the tube 43/bulb 57 can be removed. The adjustable shoulder straps 22, 24 allow for adjustment to improve comfort.

The following numbered clauses include embodiments that are contemplated and non-limiting.

Clause 1: A brassiere garment suitable for use post-mastectomy surgery, is described, comprising a vest portion having a first cup and a second cup; a front closure; an elastic support band associated with a bottom portion of the vest portion; at least one elastic strip associated with the support band; at least one retention member removably attachable to a portion of the at least one elastic strip; and, a pouch adapted to be removably associated with a portion of the at least one elastic strip.

Clause 2: The garment of Clause 1, wherein the at least one retention member is at least one split ring.

Clause 3: The garment of Clause 1, wherein the front closure comprises at least one hook and at least one eyelet.

Clause 4: The garment of Clause 1, wherein each at least one retention member comprises a split ring.

Clause 5: The garment of Clause 1, further comprising at least one opening formed in the vest portion.

Clause 6: The garment of Clause 5, wherein the opening comprises a first flap and second flap formed in the vest portion.

Clause 7: The garment of Clause 5, further including at least one tube adapted to be passed through one of the at least one openings.

Clause 8: The garment of Clause 1, further including at least one bulb adapted to be removably retained in the pouch.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

As used in the specification and the appended claims, the singular forms "a," "an" and "the" include plural referents unless the context clearly dictates otherwise.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

What is claimed is:

1. A brassiere garment suitable for use post-mastectomy surgery, comprising:

a vest portion having a first cup and a second cup;

a front closure;

an elastic support band coupled to a bottom portion of the vest portion;

at least one elastic strip coupled to the support band, the at least one elastic strip configured to provide a plurality of attachment areas around the support band;

at least one retention member removably attachable to the attachment areas of the at least one elastic strip and configured to support a drainage tube relative to the support band; and, an attachment portion of a pouch removably attachable to the attachment areas of the at least one elastic strip, the pouch configured to support a drainage bulb relative to the support band, wherein a plurality of tack stitches are formed across the at least one elastic strip and define the plurality of attachment areas, the plurality of tack stitches separate adjacent attachment areas of the plurality of attachment areas, the at least one retention member is configured to be removed from one of the attachment areas and attached to another of the attachment areas at the selection of a user, the attachment portion of the pouch is configured to be removed from one of the attachment areas and attached to another of the attachment areas at the selection of a user, and the plurality of tack stitches are configured to block movement of the at least one retention member along the at least one elastic strip from one of the attachment areas to another of the attachment areas.

2. The garment of claim 1, wherein the at least one retention member is at least one split ring.

3. The garment of claim 1, wherein the front closure comprises at least one hook and at least one eyelet.

4. The garment of claim 1, wherein each at least one retention member comprises a split ring.

5. The garment of claim 1, further comprising at least one opening formed in the vest portion.

6. The garment of claim 5, wherein the opening comprises a first flap and second flap formed in the vest portion.

7. The garment of claim 5, further including at least one tube adapted to be passed through one of the at least one openings.

8. The garment of claim 1, further including at least one bulb adapted to be removably retained in the pouch.

9. A brassiere garment suitable for use post-mastectomy surgery, comprising:

a vest portion having a first cup and a second cup;

a front closure;

an elastic support band coupled to a bottom portion of the vest portion;

at least one elastic strip coupled to the support band, the at least one elastic strip configured to provide a plurality of attachment areas around the support band;

at least one retention member removably attachable to the attachment areas of the at least one elastic strip and configured to support a drainage tube relative to the support band; and an attachment portion of a pouch removably attachable to the attachment areas of the at least one elastic strip, the pouch configured to support a drainage bulb relative to the support band, wherein a plurality of tack stitches are formed across the at least one elastic strip and define the plurality of attachment areas, the plurality of tack stitches separate adjacent attachment areas of the plurality of attachment areas, the at least one retention member is configured to be removed from one of the attachment areas and attached to another of the attachment areas at the selection of a user, the attachment portion of the pouch is configured to be removed from one of the attachment areas and attached to another of the attachment areas at the selection of a user, and adjacent tack stitches of the plurality of tack stitches maintain the at least one retention member within one of the attachment areas defined by the adjacent tack stitches to which the at least one retention member is attached.

10. The garment of claim 1, wherein the plurality of tack stitches are configured to block movement of the attachment portion of the pouch along the at least one elastic strip from one of the attachment areas to another of the attachment areas.

11. The garment of claim 1, wherein adjacent tack stitches of the plurality of tack stitches maintain the attachment portion of the pouch within one of the attachment areas defined by the adjacent tack stitches to which the attachment portion of the pouch is attached.

12. The garment of claim 1, wherein the plurality of tack stitches attach the at least one elastic strip to the elastic support band to define the plurality of attachment areas.

13. The garment of claim 1, wherein the plurality of attachment areas includes a first plurality of attachment areas arranged adjacent to the first cup and a second plurality of attachment areas arranged adjacent to the second cup.

14. The garment of claim 13, wherein the first plurality of attachment areas is separated from the second plurality of attachment areas by the front closure.

15. A brassiere garment suitable for use post-mastectomy surgery, comprising:

a vest portion having a first cup and a second cup;

a front closure;

an elastic support band coupled to a bottom portion of the vest portion;

at least one elastic strip coupled to the support band, the at least one elastic strip configured to provide a plurality of attachment areas around the support band, the plurality of attachment areas including at least a first attachment area, a second attachment area, a third attachment area, and a fourth attachment area;

at least one retention member removably attachable to the first and second attachment areas of the at least one elastic strip and configured to support a drainage tube relative to the support band; and, an attachment portion of a pouch removably attachable to the third and fourth attachment areas of the at least one elastic strip, the pouch configured to support a drainage bulb relative to the support band, wherein a plurality of tack stitches are formed across the at least one elastic strip and define the first, second, third, and fourth attachment areas, the plurality of tack stitches separate the first, second, third, and fourth attachment areas from one another, the at least one retention member is configured to be removed from the first attachment area and attached to the second attachment area at the selection of a user, the attachment portion of the pouch is configured to be removed from the third attachment area and attached to the fourth attachment area at the selection of a user, and the plurality of tack stitches are configured to block movement of the at least one retention member along the at least one elastic strip from the first attachment area to the second attachment area.

16. The garment of claim 15, wherein the plurality of tack stitches are configured to block movement of the attachment portion of the pouch along the at least one elastic strip from the third attachment area to the fourth attachment area.

17. The garment of claim 15, wherein the plurality of tack stitches attach the at least one elastic strip to the elastic support band to define the first, second, third, and fourth attachment areas.

* * * * *